United States Patent [19]

Gardner et al.

[11] Patent Number: 4,841,956

[45] Date of Patent: Jun. 27, 1989

[54] APPARATUS FOR INDUCING VENOUS-RETURN FLOW FROM THE LEG

[75] Inventors: Arthur M. N. Gardner; Roger H. Fox, both of Devon, England

[73] Assignee: Electro-Biology, Inc., Parsippany, N.J.

[21] Appl. No.: 94,286

[22] Filed: Aug. 20, 1987

Related U.S. Application Data

[62] Division of Ser. No. 787,124, Oct. 15, 1985, Pat. No. 4,702,232.

[51] Int. Cl.[4] ..... A61H 9/00

[52] U.S. Cl. ..... 128/64; 128/24 R

[58] Field of Search ..... 128/64, 24 R

[56] References Cited

U.S. PATENT DOCUMENTS

| | | | |
|---|---|---|---|
| 1,608,239 | 11/1926 | Rosett | 128/64 |
| 2,531,074 | 11/1950 | Miller | 128/64 |
| 2,694,395 | 11/1954 | Brown | 128/64 |
| 3,811,431 | 5/1974 | Apstein | 128/64 |
| 3,824,992 | 7/1974 | Nicholson et al. | 128/64 |
| 3,942,518 | 3/1976 | Tentaris et al. | 128/64 |
| 4,311,135 | 1/1982 | Brueekner et al. | 128/64 |
| 4,502,470 | 3/1985 | Kiser et al. | 128/64 |
| 4,577,626 | 3/1986 | Marukawa et al. | 128/64 |
| 4,614,179 | 9/1986 | Gardner et al. | 128/64 |
| 4,614,180 | 9/1986 | Gardner | 128/64 |
| 4,624,244 | 11/1986 | Taheri | 128/24 R |
| 4,696,289 | 9/1987 | Gardner et al. | 128/64 |
| 4,702,232 | 10/1987 | Gardner | 128/64 |

FOREIGN PATENT DOCUMENTS

| | | | |
|---|---|---|---|
| 2390156 | 1/1979 | France | 128/64 |
| 0632354 | 11/1978 | U.S.S.R. | 128/64 |

*Primary Examiner*—Edgar S. Burr
*Assistant Examiner*—Tonya Lamb
*Attorney, Agent, or Firm*—Hopgood, Calimafde, Kalil, Blaustein & Judlowe

[57] ABSTRACT

Venous blood flow in a non-ambulating human leg is involuntarily promoted in a repeating cycle of successively actuated venous pumps, in imitation of the pump-actuating sequence which characterizes normal walking. Specifically, in the preferred embodiment, the proximal calf pump and the distal calf pump are operated, in that sequential order, following a given operation of the foot pump and prior to the next successive operation of the foot pump.

7 Claims, 1 Drawing Sheet

APPARATUS FOR INDUCING VENOUS-RETURN FLOW FROM THE LEG

This application is a division of copending application Ser. No. 787,124, filed Oct. 15, 1985, now U.S. Pat. No. 4,702,232.

BACKGROUND OF THE INVENTION

The invention relates to the artifically induced flow of venous blood in a human leg which, for one reason or another, may be impaired, in that normal processes associated with normal walking are either inadequate or not available to the patient.

In our earlier and pending patent applications, Ser. No. 621,499 (now abandoned), Ser. No. 794,43 3 (now U.S. Pat. No. 4,614,179) and Ser. No. 763,686 (now U.S. Pat. No. 4,614,180), we disclose inflatable bladder or cuff means for promoting return flow of venous blood, by pulsed compression of the blood vessels within the plantar arch, the same being accomplished by transient flattening of the plantar arch and/or by transient upward application of squeezing force against the sole of the foot. In either case, the action is localized between the ball and the heel of the foot. In the case of flattening the plantar arch, spreading force is directed at and between the ball and heel of the foot; in the other case, the sole of the foot is squeezed upward against the underside of reacting metatarsal and tarsal bone structure.

In normal walking, the foot is intermittently weight-bearing, as a result of which the involved plantar arch is transiently flattened and foot-pump action proceeds, with little or no muscular intervention. The devices and methods of said patent applications are operative to produce foot-pump action in non-weight-bearing circumstances, as when the patient is bed-ridden or the leg is in a cast.

Effective as our foot-pump actuating method and bladder devices may be, the fact remains that such actuation of the foot pump alone will not fully duplicate the pumping cycle which is the result of normal walking, for the reason that, although the foot pump is the primary pump in the leg, there are two further pumps which importantly contribute in each cycle of normal walking. These two further pumps are in the calf and, unlike the foot pump, are normally muscle-actuated. More specifically, in walking forward, and after weight has been borne on the sole of the foot, the muscles in the upper part of the calf contract to planatarflex the ankle; and, in contracting, these muscles squeeze and empty affected veins, thus operating the proximal venous calf pump. Subsequently, as the leg is swung forward to take another step, the ankle is dorsiflexed to prevent the toes from dragging on the ground, and this action empties the distal calf pump. And finally, as weight is borne once more on the sole of the foot, the venous calf pumps are again primed.

BRIEF STATEMENT OF THE INVENTION

It is an object of the invention to provide an improved method and means of promoting and/or enhancing venous-blood flow in a human leg.

A specific object is to achieve the above object by involuntarily activating a foot pump in such squential relation with one or more venous pumps of the same limb as to imitate the cyclical succession of venous pump action which would occur in normal walking.

It is also an object to achieve the foregoing objects with relatively simple and inexpensive procedure and apparatus.

The invention achieves the foregoing objects by activating the foot pump in the manner of said pending patent applications and by further activating one or more venous pumps of the same leg, such actuations being in the sequential relation which also applied for the case of normal walking in the forward direction.

DETAILED DESCRIPTION

Figure 1:
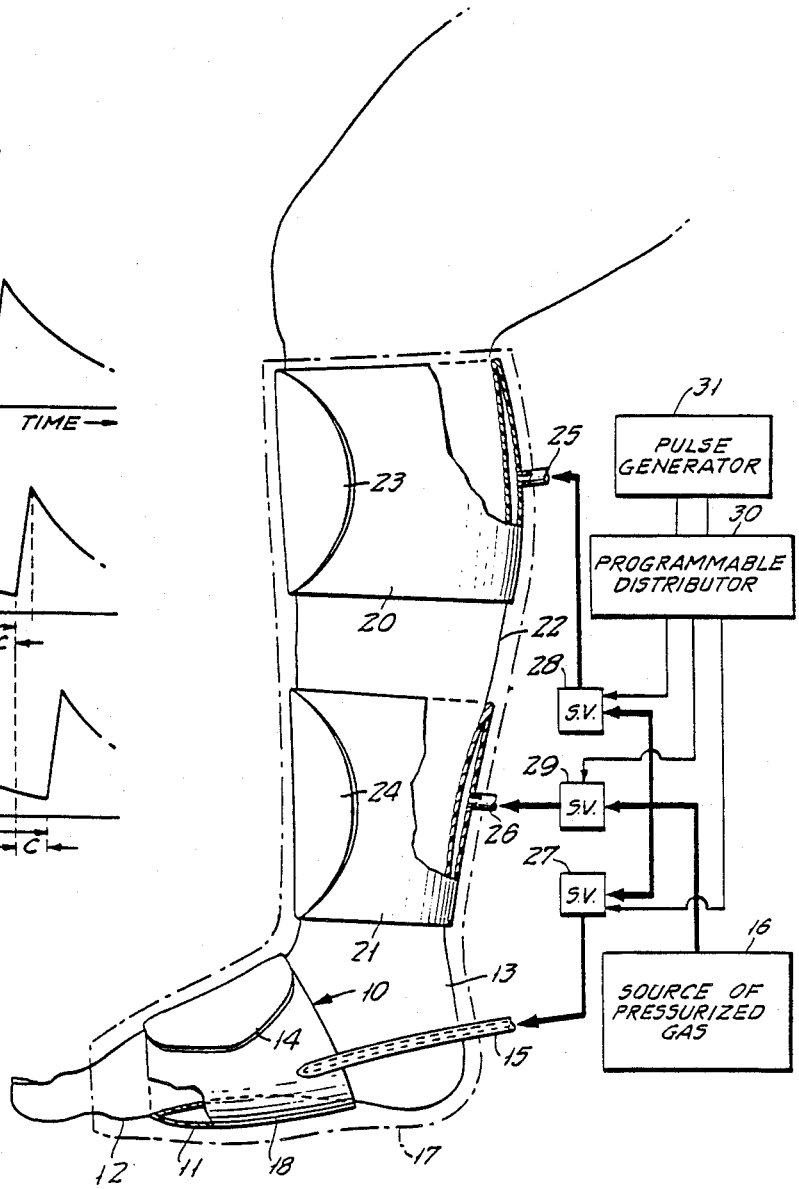
Figure 2:
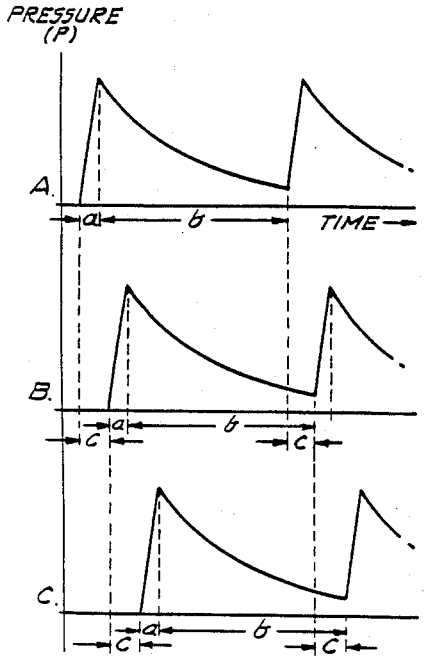

A presently preferred embodiment of the invention will be described in detail, in conjunction with the accompanying drawings, in which:

FIG. 1 is a simplified view in side elevation of the calf and foot extremity of a leg to which apparatus of the invention has been applied; and FIG. 2 is a succession of pressure profiles to the same time scale to illustrate the phased relation of different pump actuations in a cycle of operation of the invention.

In FIG. 1, a foot-pump actuator 10 includes an inflatable bag 11 formed of plastics material and shaped for engagement with the sole 12 of a human foot 13 in the plantar arch thereof. Bag structures of this kind are described in greater detail in said pending patent applications and therefore elaboration is not new needed. It suffices to state that in a preferred embodiment one or both of the panels which define the bag 11 are perforated for the venting of pressure fluid (e.g., compressed air or oxygen) used to periodically inflate the bag. The bag 11 (of appropriate size) is longitudinally limited by and between the ball and heel of the foot and may circumferentially envelop all or a part of the mid-tarsal region of the foot; it may thus form part of a shaped cuff having a retaining tab end 14 which removably laps and is adhered to an upper part of the bag, as shown. A flexible pipe 15 connects the bag to fluid-pressure supply means, to be later described but shown to include a source 16 of pressurized gas.

As described in said pending applications, the inflatable actuator 10 may be contained within an orthopedic cast, in which case the phantom outline 17 will be understood to identify the same. Alternatively, the panel 18 of flexible material which is the outer half of the bag may be stoutly resistive to stretch, thus providing a circumferential tie, whereby bag-inflation pressures are assuredly inward, against at least the plantar region of the sole 12, being operative to spread apart the ball and heel, thus to a degree flattening the plantar arch.

In accordance with the invention, further pump actuators 20–21 are also fitted to the respective upper and lower regions on the calf, for transient squeezing actuation of the proximal and distal venous-pump regions of the calf 22. Each of the actuators 20–21 may be an inflatable cuff, held in place by a circumferential wrap of the calf, and removably secured by tab means 23-24 in the manner described for tab 14. Flexible pipes 25–26 receive pressure fluid for inflation. Again, at least one of the panels of each inflatable cuff may be perforated, and the outer panel in each case is preferably stoutly resistive to stretch. Each of the calf cuffs 20–21 may be as wide as 10 centimeters.

The means shown for connection of all inflatable cuffs to the pressure source 16 is a solenoid valve, there being one such valve 27, 28, 29 for each of the respective supply lines 15, 25, 26; and all valves 27, 28, 29 have common connection to source 16. Valves 27, 28, 29 are controlled in sequence by separate electrical pulse signals issuing from the respective outputs of a programmable distributor 30, coacting with a pulse generator 31. The sequence of pulsed actuation of the solenoid valves is in a recurrent cycle wherein valve 27 activates the foot-pump cuff 10, then valve 28 actuates the proximal cuff 20, and valve 29 thereafter actuates the distal cuff 21.

The relative timing of cuff inflations will be better appreciated from discussion in connection with FIG. 2, wherein curve A is the profile of inflation pressure at the foot-pump cuff, curve B is the profile of inflation pressure at the proximal venous calf pump 20 and curve C is the profile of inflation pressure at the distal venous calf pump 21. Pressure profiles are in every case closely alike being supplied by a common source affected essentially only by the phase-delaying action of the distributor 30. Each profile comprises a steep rise of short duration a, within two second and preferably in the order of less than one second, at which point the applicable solenoid valve closes to allow relatively slow pressure drop off, via perforation leakage or active deflation; at lapse of a longer interval b, which is in the range 10 to 60 seconds, the cycle repeats for each cuff by which time inflation pressure will have dropped in each cuff at least to one seventh of maximum pressure. The maximum (or peak) inflation pressure may be as much as 220-mm Hg.

The time delay c between foot-pump actuation (curve A) and proximal calf pump actuation (curve B) may be up to fifteen second and is preferably about three or four seconds. This same time delay c also applies between proximal calf pump actuation and distal calf pump actuation (curve C). On the other hand, the interval between distal calf pump actuation and foot-pump actuation (curve A) shoud not curtail the interval b which will be understood to allow foot-pump priming between successive foot-pump actuations; stated in other words, the interval after calf-pulsing and the next-succeeding pulse to the foot cuff is in the range of 10 to 50 seconds and preferably in the range of 15 to 40 seconds.

The described apparatus and the mode of its operation will be seen to meet all stated objects. The volumetric inflatable capacity of all cuffs may be substantially the same, and the inflation pressure profile of all cuffs may be substantially the same, thus simplifying the apparatus and administration of the method. The operation of calf pumps between foot-pump actuations means an emptying of some of the venous return system (e.g., of the distal calf pump) before actuation of the foot pump, thus naturally conditioning veins for the next foot-pump generated flow, and with greater physiological toleration by the patient.

Although the invention has been described in detail for a preferred embodiment, it will be understood that modification may be made without departing from the scope of the invention. For example, operation of the foot pump in alternation with one but not necessarily both calf pumps can produce therapeutically beneficial results, especially when a local disability of the patient may preclude pump action at one of the calf-pump sites. Still further, the invention may utilize other forms of pump actuator and is therefore not limited to the particular inflatable cuff means that has been shown and described. In all cases, use of the invention is particularly tolerable to the patient, and a swollen region of the leg can be relieved and reduced, with the probability of reduced chances of a thrombosis.

What is claimed is:

1. A medical appliance for promoting venous-blood flow in a human leg, said appliance comprising a first acutator for application circumferentially to the foot to induce individually pulsed actuation of the foot pump of the leg, a second actuator for application circumferentially to the proximal region of the calf to induce individually pulsed actuation of the proximal calf pump of the leg, a third actuator for application circumferentially to the distal region of the calf to induce individually pulsed actuation of the distal calf pump of the leg, and cyclically operative means connected to all said actuators and operative to sequentially operate said actuators in the sequence of first-actuator pulsed operation, then second-actuator pulsed operation, then third-actuator pulsed operation, with a period of relaxation between third-actuator pulsed operation and the next cycle of said sequence, said period of relaxation being free of pulsed actuation and exceeding (a) the time between first-actuator pulsed operation and second-actuator pulsed operation, and (b) the time between second-actuator pulsed operation and third-actuator pulsed operation.

2. A medical appliance, comprising a first inflatable cuff having circumferential-tie means adapted to peripherally envelop essentially only and to conform generally to the instep region of a foot and to the plantar region of the foot within the span between the ball and heel of the foot, a single inflatable bag defined within said circumferential-tie means and having an active-surface portion longitudinally limited to said span and conformable to the sole of the foot within said span; a second inflatable cuff shaped for circumferential engagement with the upper calf of the leg; a third inflatable cuff shaped for circumferential engagement with the lower calf of the leg; and cyclically operative pneumatic means to individually and transiently inflate said cuffs in a cycling sequence of first-cuff inflation, then second-cuff inflation, then third-cuff inflation, with a period of relaxation between third-cuff actuation and the next cycle of said sequence said period of relaxation exceeding (a) the time between first-cuff inflation and second-cuff inflation and (b) the time between second-cuff inflation and third-cuff inflation.

3. A medical appliance comprising a first inflatable cuff having circumferential-tie means adapted to peripherally envelop essentially only and to conform generally to the instep region of a foot and to the plantar region of the foot within the span between the ball and heel of the foot, a single inflatable bag defined within said circumferential-tie means and having an active-surface portion longitudinally limited to said span and conformable to the sole of the foot within said span; a second inflatable cuff shaped for circumferential engagement with the upper calf of the leg; and cyclically operative pneumatic pulsing means to individually and only transiently inflate said cuffs in a cycling sequence comprising a peaked first-cuff inflation pulse, and then a peaked second-cuff inflation pulse, wherein the peaks of said inflation pulses are spaced in time, and wherein there is a period of relaxation between the second-cuff inflation-pulse peak and the next cycle of said sequence, said period of relaxation exceeding the time between peaks of said first-cuff and second-cuff pulses.

4. A medical appliance comprising a first inflatable cuff having circumferential-tie means adapted to peripherally envelop essentially only and to conform generally to the instep region of a foot and to the plantar region of the foot within the span between the ball and heel of the foot, a single inflatable bag defined within said circumferential-tie means and having an active-surface portion longitudinally limited to said span and conformable to the sole of the foot within said span; a second inflatable cuff shaped for circumferential engagement with the lower calf of the leg; and cyclically operative pneumatic pulsing means to individually and only transiently inflate said cuffs in a cycling sequence comprising a peaked first-cuff inflation pulse, then a peaked second-cuff inflation pulse, wherein the peaks of said inflation pulses are spaced in time, and wherein there is a period of relaxation between the second-cuff inflation-pulse peak and the next cycle of said sequence, said period of relaxation exceeding the time between peaks of said first-cuff and second-cuff pulses.

5. A medical appliance according to any one of claims 2, 3 and 4, wherein said cyclically operative pneumatic means includes a distributor having separate supply-tube connections to the respective cuffs and wherein said pulsing means is operative to provide cuff-pulsing pressure in accordance with the following criteria:

(a) for each pulse, a pressure rise to a predetermined maximum of 220-mm Hg or less within two seconds;

(b) upon achievement of said maximum; dropping the pressure in each cuff at least to one seventh of said maximum pressure before repeating pulsed application of pressure to said each cuff;

(c) providing a delay interval in the range up to fifteen seconds between a pulse to the foot cuff and the next-succeeding pulse to a calf cuff; and (d) providing an interval in the range of 10 to 50 seconds after calf-cuff pulsing and the next-succeeding pulse to the foot cuff.

6. A medical appliance according to any one of claims 2, 3 and 4, wherein said pulsing means is operative to provide calf-pulsing pressure in accordance with the following criteria:

(a) for each pulse, a pressure rise to a predetermined maximum of 220-mm Hg or less within two seconds;

(b) upon achievement of said maximum, dropping the pressure in each cuff at least to one seventh of said maximum pressure before repeating pulsed application of pressure to said each cuff;

(c) providing an interval in the range of about three or four seconds between a pulse to the foot cuff and the next-succeeding pulse to a calf cuff; and (d) providing an interval in the range of 10 to 50 second after calf-cuff pulsing and the next-succeeding pulse to the foot cuff.

7. A medical appliance according to any one of claims 2, 3 and 4, wherein said pulsing means is operative to provide cuff-pulsing pressure in accordance with the following criteria:

(a) for each pulse, a pressure rise to a predetermined maximum of 220-mm Hg or less within two seconds;

(b) upon achievement of said maximum, dropping the pressure in each cuff at least one seventh of said maximum pressure before repeating pulsed application of pressure to said each cuff;

(c) providing a delay interval in the range up to fifteen seconds between a pulse to the foot cuff and the next-succeeding pulse to a calf cuff; and (d) providing an interval in the range of 15 to 40 seconds after calf-cuff pulsing and the next-succeeding pulse to the foot cuff.

* * * * *